US012078087B2

(12) United States Patent
Ayarturk

(10) Patent No.: US 12,078,087 B2
(45) Date of Patent: Sep. 3, 2024

(54) EFFICIENCY AND COMFORT SYSTEM FOR MOTORIZED VEHICLES

(71) Applicant: REPG ENERJI SISTEMLERI SANAYI VE TICARET ANONIM SIRKETI, Bursa (TR)

(72) Inventor: Hasan Ayarturk, Istanbul (TR)

(73) Assignee: REPG ENERJI SISTEMLERI SANAYI VE TICARET ANONIM SIRKETI, Bursa (TR)

( * ) Notice: Subject to any disclaimer, the term of this patent is extended or adjusted under 35 U.S.C. 154(b) by 0 days.

(21) Appl. No.: 18/282,223

(22) PCT Filed: Jan. 31, 2022

(86) PCT No.: PCT/TR2022/050084

§ 371 (c)(1),
(2) Date: Sep. 15, 2023

(87) PCT Pub. No.: WO2022/203626

PCT Pub. Date: Sep. 29, 2022

(65) Prior Publication Data

US 2024/0159171 A1 May 16, 2024

(30) Foreign Application Priority Data

Mar. 24, 2021 (TR) ..... 2021/005337

(51) Int. Cl.
*F01K 23/06* (2006.01)

(52) U.S. Cl.
CPC ..... *F01K 23/065* (2013.01)

(58) Field of Classification Search
CPC ..... F01K 23/065
See application file for complete search history.

(56) References Cited

U.S. PATENT DOCUMENTS

2008/0223023 A1* 9/2008 Robel ..... F02B 41/10 60/303
2013/0160722 A1* 6/2013 Kyle ..... F01D 15/10 123/2
2013/0192216 A1* 8/2013 Berlin, Jr. ..... F02C 6/16 60/413
2018/0119578 A1* 5/2018 Zhou ..... F01N 5/02
2019/0003419 A1 1/2019 Patel et al.
2019/0249589 A1* 8/2019 Ernst ..... F25B 27/02
2020/0148053 A1 5/2020 Stoltz

FOREIGN PATENT DOCUMENTS

WO 2011122294 A1 10/2011
WO 2018080895 A1 5/2018

* cited by examiner

*Primary Examiner* — Shafiq Mian
(74) *Attorney, Agent, or Firm* — Bayramoglu Law Offices LLC

(57) ABSTRACT

A heat recovery system is provided. The heat recovery system comprises at least one heat exchanger capable of transferring heat from a first fluid heated by the engine to at least one second fluid, at least one turbine capable of obtaining motion energy from the second fluid pressurized by heating in said heat exchanger, at least one condenser capable of discharging the heat of the second fluid exiting said turbine and transferring it back to the heat exchanger, and at least one alternator capable of converting the motion energy obtained from the turbine into electrical energy.

9 Claims, 1 Drawing Sheet

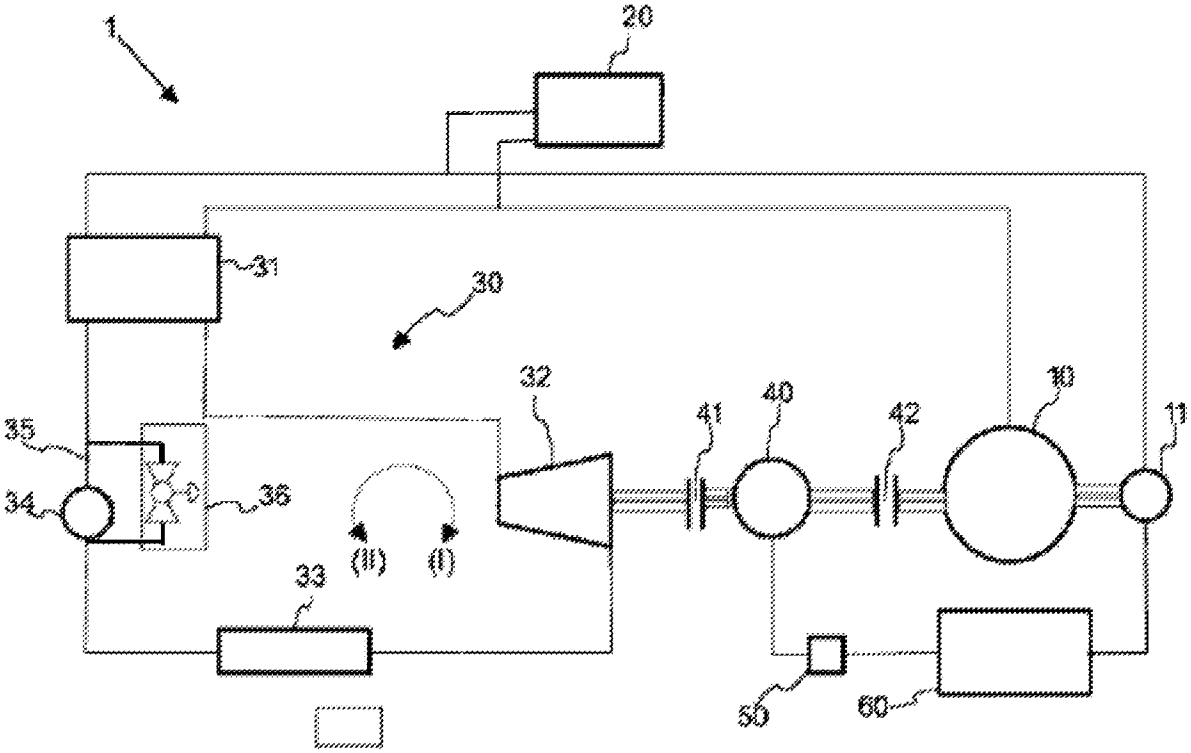
1
20
30
31
32
33
34
35
36
40
41
42
50
60
10
11
(I)
(II)

EFFICIENCY AND COMFORT SYSTEM FOR MOTORIZED VEHICLES

CROSS REFERENCE TO THE RELATED APPLICATIONS

This application is the national phase entry of International Application No. PCT/TR2022/050084, filed on Jan. 31, 2022, which is based upon and claims priority to Turkish Patent Application No. 2021/005337, filed on Mar. 24, 2021, the entire contents of which are incorporated herein by reference.

TECHNICAL FIELD

The invention relates to at least one heat recovery system that can allow the waste heat emitted to the environment from a vehicle's engine that can move a vehicle to be taken and made available again, thereby increasing the efficiency and comfort of the vehicles.

BACKGROUND

The need for renewable energy resources is increasing day by day to ensure energy security and combat climate change in the world. However, the biggest challenge we face in using renewable energy sources is the high installation costs required for renewable energy sources. Therefore, reducing these high costs as much as possible, increasing the efficiency of existing systems, and improving them by using the losses found here, will benefit both the environment and the country's economies.

Today, internal combustion vehicles and transportations are one of the areas where energy use is largest. Most of the vehicles are still powered by fossil fuels such as diesel and gasoline, and the transitions to electric vehicles are still not at the desired levels. Vehicles with internal combustion engines can effectively use a very small part of the fuel they use, most of it is lost during the transmission of waste heat and movement in the engine/exhaust to the vehicle's drivetrain. Improvements are needed to increase the efficiency of the fuel spent by making various improvements in these vehicles for this reason.

Recovery of waste heat using thermoelectric generators in internal combustion engines is an alternative green energy technology to increase fuel economy and reduce carbon dioxide emissions in vehicles. Approximately 70% of the thermal power obtained on the piston is lost by exhaust and cooling in internal combustion engines. A beneficial energy of approximately 25% is generated in the engine output shaft after engine friction losses. Studies are carried out especially on the cooling and exhaust system for the recovery of the waste heat of internal combustion engines. The use of thermoelectric energy is at the forefront, especially when the heat is idle and not recycled.

Application No. US2019/003419 known in the art relates to a waste heat recovery system. This recovery system includes a turbocharger part, an exhaust part, an expander in the exhaust part, a condenser, valves, and a controller. The condenser condenses the working fluid for recirculation through the engine system. The expander receives a working fluid in an overheated form and converts the thermal energy in the working fluid into mechanical energy or electrical energy.

Application No. US2020/148053 known in the art comprises a transmission system, a waste heat recovery system, a brake assembly and a phase-change thermal heat storage system, which are selectively connected to a engine crankshaft of an internal combustion engine on the vehicle. The waste heat recovery system selectively circulates a fluid in the transmission system. The brake assembly is configured to operate in a braking mode that delays the relative rotation between the transmission output shaft and the drive axle while generating heat. The heat storage system includes a housing defining at least one space and a fluid transfer manifold. There is a phase change material in the space configured to change phase during braking mode. The waste heat recovery system circulates the fluid through the fluid transfer manifold that collects the braking heat. It is tried to obtain energy recovery from the heat accumulated on the fluid in this way.

Energy generation from exhaust waste heat has been tried in the known art. However, the waste heat mentioned here is at a higher temperature than the engine waste heat. The waste heat generated in the engines of the vehicles is discharged to the air through the radiator in the art. Today, the number of vehicles is constantly increasing and for this reason, the waste heat of the vehicles heat the air and have a small effect on global warming. In addition, most of the energy generated during combustion in the engine is wasted and cannot be converted into mechanical energy. In addition to all these, more load is placed on the engine, more fuel is consumed or the engine traction performance of the vehicle decreases, and carbon emissions increase when using air conditioning in heating/cooling operations. Even though recovery from vehicle heat is tried to be obtained, the desired level of energy recovery cannot be achieved in these structures known in the art.

All the problems mentioned above have made it necessary to make an innovation in the relevant technical field as a result.

SUMMARY

The present invention relates to a heat recovery system in order to eliminate the above-mentioned disadvantages and to bring new advantages to the related technical field.

An object of the invention is to provide at least one heat recovery system that converts the waste heat of the vehicle into electrical energy.

Another object of the invention is to provide a heat recovery system that can allow the operation of the air conditioning system without running the engines of vehicles with an internal combustion engine.

Another object of the invention is to provide a heat recovery system that can allow the production of electricity during braking or at idle.

The present invention is at least one heat recovery system that can allow the waste heat emitted to the environment from a engine that can move a vehicle to be taken and made available again in order to realize all the purposes that are mentioned above and will emerge from the following detailed description. Accordingly, its novelty is that it comprises at least one heat exchanger capable of transferring heat from a first fluid heated by the engine to at least one second fluid, at least one turbine capable of obtaining motion energy from the second fluid pressurized by heating in said heat exchanger, at least one condenser capable of discharging the heat of the second fluid exiting said turbine and transferring it back to the heat exchanger, and at least one alternator capable of converting the motion energy obtained from the turbine into electrical energy. Thus, electrical energy can be obtained from the waste heat of vehicle engines.

A possible embodiment of the invention is characterized in that the electrical energy converted in said alternator can be used directly in the vehicle and can be accumulated in at least one battery. Thus, the obtained electrical energy can be stored in order to be used in the future.

Another possible embodiment of the invention is characterized in that there is at least one first clutch for selectively transferring movement between the alternator and the turbine. Thus, the turbine and the alternator are connected to each other in a detachable manner.

Another possible embodiment of the invention is characterized in that the alternator and the engine are connectable by at least one second clutch to selectively transfer movement between them. Thus, it is ensured that the turbine and the engine are connected to each other in a detachable manner.

Another possible embodiment of the invention is characterized in that the operation of the alternator is manageable by means of at least one control unit. Thus, the user can manage the vehicle according to different conditions.

Another possible embodiment of the invention is characterized in that in order to ensure the operation of the air conditioning system of the vehicle when the engine of the vehicle is not running, the alternator can be actuated by the battery, the turbine actuated by the alternator can compress the second fluid and accordingly the second fluid is heated and the heated second fluid transfers its heat to the first fluid through the heat exchanger and the heat on the first fluid is configured to be conveyed to the air conditioning system. Thus, it is ensured that the vehicle interior can be heated with the elements in the heat recovery system while the vehicle is not running.

Another possible embodiment of the invention is characterized in that it is connected to at least one circulation pump to ensure the transport of the first fluid. It is thus possible to continuously recirculate the first fluid.

Another possible embodiment of the invention is characterized in that it can be charged through the alternator by regenerative braking in cases where the vehicle is going downhill or when the gas is not pressed. This allows the vehicle to generate electricity during braking or at idle.

Another possible embodiment of the invention is characterized in that it comprises at least one extra pump to support the second fluid movement. Thus, it is ensured that the second fluid can be circulated in the heat recovery system.

Another possible embodiment of the invention is characterized in that it comprises at least one valve to provide flow control. Thus, it can be ensured that the second fluid is directed to the extra pump when needed.

Another possible embodiment of the invention is characterized in that the exhaust gas heat as the first fluid is configured to be received by the recuperator application. Thus, electricity can be obtained from the exhaust heat.

BRIEF DESCRIPTION OF THE DRAWINGS

A representative schematic view of a vehicle with the heat recovery system of the invention is given in the FIGURE.

REFERENCE NUMBERS GIVEN IN THE FIGURE

1 Vehicle
10 Engine
11 Circulation Pump
20 Air Conditioning System
30 Heat Recovery System
31 Heat Exchanger
32 Turbine
33 Condenser
34 Extra Pump
35 Check Valve
36 Valve
40 Alternator
41 First Clutch
42 Second Clutch
50 Control Unit
60 Battery
(I) First Flow Direction
(II) Second Flow Direction

DETAILED DESCRIPTION OF THE EMBODIMENTS

The subject of the invention is explained with examples that do not have any limiting effect only for a better understanding of the subject in this detailed description.

The invention relates to a heat recovery system (30). Said heat recovery system (30) provides energy recycling by using the waste heat coming out of the internal combustion engine (10), especially during running of the vehicle (1). Heat recovery system (30) is based on absorbing the heat in the water of the engine (10) and converting it into electrical energy for this. The electrical energy need of the vehicle (1) can be met at least partially in this way. In addition, it can be stored in the battery (60) of the vehicle (1) in case of excess electrical energy with the heat recovery system (30). Said battery (60) may be the battery of the vehicle (1) or the battery packs in which the electric vehicles store energy.

A representative schematic view of a vehicle (1) with the heat recovery system (30) of the invention is given in the FIGURE. Accordingly, the heat recovery system (30) needs at least one first fluid containing the waste heat provided from the engine (10) of the vehicle (1) in order to obtain electrical energy. The first fluid may be the cooling fluid of the engine (10) in preferred embodiments of the invention. Thus, while cooling the engine (10) on the one hand, the heat in the first fluid can be recycled on the other hand. The transport of the first fluid to the heat recovery system is provided by at least one circulation pump (11). Said circulation pump (11) is associated with the engine (10) of the vehicle (1) and circulates the first fluid in the heat recovery system (30).

The heat of the first fluid can be absorbed by means of at least one heat exchanger (31) in the heat recovery system (30). Said heat exchanger (31) may be a heat exchanger known in the art. The heat exchanger (31) allows heat exchange between the first fluid and a second fluid present in the heat recovery system (30). This heat transfer can also be bi-directional. The second fluid in the heat recovery system (30) can be a kind of gas that efficiently carries heat at high temperatures. The kinetic energy increases with the heat transferred by this gas from the first fluid.

The heat recovery system (30) has at least one turbine (32) associated with the heat exchanger (31). Said turbine (32) is the tool used to convert the kinetic energy of this second fluid into work. The turbine (32) may have a shaft and its flaps thereon. The second fluid hits the flaps of the turbine (32) and moves to the shaft of the turbine (32), the movement transforms into mechanical work at the output of the shaft.

The heat recovery system (30) has at least one condenser (33) adjacent to the turbine (32). Said condenser (33) allows the heat of the second fluid whose kinetic energy is used in the turbine (32) to be discharged. The condenser (33) discharges the waste heat of the heated fluid and the remaining waste heat from the recovery to the environment. Cooling of the fluid is provided in this way. The flow recirculation is completed by directing the cooled fluid back to the heat exchanger (31).

An extra pump (34) can be used to improve fluid circulation in the heat recovery system (30). Said extra pump (34) may circulate to support the movement of the second fluid pressurized. In addition, there may be at least one check valve (35) adjacent to the extra pump (34). Said check valve (35) enables the flow to be made in one direction. The check valve (35) essentially provides a passive safety measure for the system.

The turbine (32) can be connected with at least one alternator (40) in the heat recovery system (30). Said alternator (40) is an electromechanical element that converts mechanical energy into electrical current. The mechanical energy obtained from the turbine (32) by the alternator (40) is converted into electrical energy. The electrical energy obtained can be used instantly in the vehicle (1) or stored in a battery (60) in the structure of the vehicle (1).

The alternator (40) mentioned in the invention can be associated with the turbine (32) on one side and with the engine (10) of the vehicle (1) on the other. There is at least one first clutch (41) between the alternator (40) and the turbine (32). There is at least a second clutch (42) between the alternator (40) and the vehicle's (1) engine (10). Said first clutch (41) and said second clutch (42) enable the alternator (40) to be detachably connected with other units. The first clutch (41) and the second clutch (42) can be magnetically controlled depending on the needs of the user. The association of the alternator (40) with the clutches varies depending on the first flow direction (I) and the second flow direction (II) of the heat recovery system (30). Since the clutches have magnetic properties, they can also change their positions instantly. The instantaneous management of the first clutch (41) and the second clutch (42) can be ensured by means of at least one control unit (50). The control unit (50) can operate in an integrated way with the function keys located in a mobile device/application or vehicle for this.

The heat recovery system (30) is operated in the first flow direction (I) in the embodiment described until this point. The alternator (40) is connected to the turbine (32) through the first clutch (41) in the first flow direction (I). It is ensured that it generates electricity from the heat obtained from the first fluid when the alternator (40) is in this position. The alternator (40) also ensures that the air conditioning system (20) can operate when the vehicle (1) is not running. The heat recovery system (30) must be operated in the second flow direction (II) for this. The electricity in the battery (60) of the vehicle (1) is used for the operation of the air conditioning system (20) when the vehicle (1) is not running. Said control unit (50) can be remotely controlled by the user through said mobile application. It sends commands to the user control unit (50) for the operation of the air conditioning system (20). The control unit (50) activates the first clutch (41) and deactivates the second clutch (42) to enable the operation of the air conditioning system (20). The energy drawn from the battery (60) operates alternator (40) after the command is received. The turbine (32) condenses the second fluid, compresses it in the second flow direction (II) and increases its kinetic energy with the operation of the alternator (40). Since the second fluid is compressed, its temperature increases as well as its pressure. The second fluid, whose temperature is increased, is moved in the second flow direction (II) in the heat recovery system (30). The heat exchanger (31) transfers the heat of the second fluid to the first fluid in this case. The heated first fluid can be used as a heater in the air conditioning system (20) of the vehicle (1). Since the second fluid that transfers its heat to the first fluid in the heat exchanger (31) contains high pressure, it condenses in the condenser (33) and completes its recirculation by passing through at least one valve (36) without the need for extra pump (34). The circulation pump (11) can be driven by the energy it receives the battery (60) so that the air conditioning system (20) of the vehicle (1) can operate effectively and the first fluid can be recycled effectively in this embodiment.

When the vehicle (1) is running and the water of the engine (10) reaches a certain temperature, the heat recovery system (30) can return to the first flow direction (I) and continue to generate energy from the waste heat in this embodiment. The excess energy generated by recovering the electricity consumed feeds the battery (60) of the vehicle (1) in this way.

The first clutch (41) is deactivated and the second clutch (42) is activated, that is, the alternator (40) is separated from the turbine (32) and connected to the engine (10) of the vehicle (1) in the other embodiment. It is ensured in this embodiment that electricity is generated through the alternator (40) by regenerative braking in cases where the vehicle (1) is going downhill or when the gas is not pressed. Regenerative braking is an energy recovery mechanism that slows down a moving vehicle (1) or object by converting its kinetic energy into a form that can be used immediately or stored until it is needed. In this way, the load on the brake pads is reduced and electrical energy can be stored here instead of the energy that is emitted as lost heat. Meanwhile, the alternator (40) and the engine (10) of the vehicle (1) are connected to each other, and the alternator (40) also functions as a starter generator. The first drive can be given to the engine (10) of the vehicle (1) when the alternator (40) can be used as a starter generator. This eliminates the need to use the starter dynamo and reduces the manufacturing cost of the vehicle (1).

The electrical energy required by the air conditioning system (20) in the alternative embodiments of the invention can also be provided by operating the heat recovery system (30) in the second flow direction (II). Both energy will be generated and the air conditioning system (20) will be operated through this system and the carbon dioxide emission of the vehicle (1) will decrease in this way. In addition to the cooling fluid as the first fluid, the exhaust gas heat can also be taken by the recuperator application and given to the system in another alternative embodiment of the invention. Energy recycling is improved in this way.

The waste heat taken from the engine (10) of the vehicle (1) is converted into electrical energy through the heat recovery system (30) and used in the vehicle (1) with this whole embodiment. The air conditioning system (20) of the vehicle (1) can be used through the control unit (50) when the vehicle (1) is not running with the obtained electricity. In addition, electricity generation can be made while regenerative braking thanks to the connection of the alternator (40) with the engine (10). In addition, the need for a starter generator is eliminated by the connection of the alternator (40) with the engine (10).

The scope of protection of the invention is specified in the attached claims and cannot be limited to those explained for sampling purposes in this detailed description. It is evident that a person skilled in the art may exhibit similar embodiments in light of above-mentioned facts without drifting apart from the main theme of the invention.

What is claimed is:

1. A heat recovery system, wherein the heat recovery system allows a waste heat emitted to an environment from an engine that moves a vehicle to be taken and made available again, wherein the heat recovery system comprises the following elements;

at least one heat exchanger allowed for transferring heat from a first fluid heated by the engine to at least one second fluid, at least one turbine allowed for obtaining a motion energy from the second fluid pressurized by heating in the heat exchanger, at least one condenser allowed for discharging heat of the second fluid exiting the turbine and transferring the heat of the second fluid back to the heat exchanger, at least one alternator allowed for converting the motion energy obtained from the turbine into an electrical energy, at least one battery for using the electrical energy converted in the alternator directly in the vehicle and for accumulating the electrical energy and in order to ensure an operation of an air conditioning system of the vehicle without running the engine of the vehicle, after a user's command, upon operating the air conditioning system, a control unit is configured to activate a first clutch and to deactivate a second clutch, the alternator is allowed to be actuated by the battery, the turbine actuated by the alternator is allowed to compress the second fluid and accordingly the second fluid is heated and the heated second fluid transfers its heat to the first fluid through the heat exchanger and the heat on the first fluid is configured to be conveyed to the air conditioning system.

2. The heat recovery system according to claim 1, wherein the first clutch is configured to selectively transfer a movement between the alternator and the turbine.

3. The heat recovery system according to claim 1, wherein the alternator and the engine are connected by the second clutch to selectively transfer a movement between the alternator and the engine.

4. The heat recovery system according to claim 1, wherein an operation of the alternator is manageable by means of the control unit.

5. The heat recovery system according to claim 1, wherein the heat recovery system is connected to at least one circulation pump to ensure a transportation of the first fluid.

6. The heat recovery system according to claim 2, wherein the heat recovery system is allowed to be charged through the alternator by regenerative braking in cases where the vehicle is going downhill or when a gas is not pressed.

7. The heat recovery system according to claim 1, wherein the heat recovery system comprises at least one extra pump to support a second fluid movement.

8. The heat recovery system according to claim 1, wherein the heat recovery system comprises at least one valve to provide a flow control.

9. The heat recovery system according to claim 1, wherein an exhaust gas heat as the first fluid is configured to be received by a recuperator application.

* * * * *